US008074329B2

(12) United States Patent
Roberts

(10) Patent No.: US 8,074,329 B2
(45) **Date of Patent: *Dec. 13, 2011**

(54) SCATTER URN AND CREMATION URN CONTAINING SAME

(76) Inventor: James H. Roberts, Royal Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/618,935

(22) Filed: Nov. 16, 2009

(65) Prior Publication Data

US 2010/0269316 A1 Oct. 28, 2010

Related U.S. Application Data

(63) Continuation-in-part of application No. 11/977,163, filed on Oct. 23, 2007, now Pat. No. 7,793,393, which is a continuation-in-part of application No. 11/053,264, filed on Feb. 7, 2005, now Pat. No. 7,308,740.

(51) Int. Cl.
*A61G 17/00* (2006.01)

(52) U.S. Cl. ..... 27/1

(58) Field of Classification Search ..... 27/1, 35; D99/5; 40/124.5, 722, 725; 211/85.27; 52/134, 52/136; 220/23.87, 270
See application file for complete search history.

(56) References Cited

U.S. PATENT DOCUMENTS

| | | | | | |
|---|---|---|---|---|---|
| 3,762,597 | A | * | 10/1973 | Kaminski et al. | 220/270 |
| D268,374 | S | * | 3/1983 | Dercks et al. | D99/5 |
| 4,648,162 | A | * | 3/1987 | Daino | 27/1 |
| 4,877,203 | A | * | 10/1989 | Harden | 244/136 |
| 5,230,127 | A | * | 7/1993 | Zukowski et al. | 27/1 |
| 5,636,418 | A | * | 6/1997 | Vail et al. | 27/1 |
| 5,903,961 | A | * | 5/1999 | Parker et al. | 27/1 |
| 6,944,921 | B1 | * | 9/2005 | Gersten | 27/1 |
| 7,036,195 | B2 | * | 5/2006 | Glass | 27/1 |
| 7,475,457 | B1 | * | 1/2009 | Gersten | 27/1 |

FOREIGN PATENT DOCUMENTS

DE 29907458 U1 * 5/2000

* cited by examiner

*Primary Examiner* — William L. Miller

(74) *Attorney, Agent, or Firm* — Michael A. Guth

(57) ABSTRACT

A scatter urn adapted for the dispersal of cremains. A cremation urn with a scatter urn within it that can be easily removed. A cremation urn with a removable and replaceable panel(s) which allows for placement of an image, such as by laser engraving, on a removable panel, with a scatter urn within it. A cremation urn with a memorial photograph with a scatter urn within it.

9 Claims, 16 Drawing Sheets

SCATTER URN AND CREMATION URN CONTAINING SAME

CROSS REFERENCE TO RELATED APPLICATIONS

This application is a continuation in part of U.S. application Ser. No. 11/977,163 to Roberts, filed Oct. 23, 2007, now issued as U.S. Pat. No. 7,793,393, which is a continuation in part of U.S. application Ser. No. 11/053,264 to Roberts, filed Feb. 7, 2005, now issued as U.S. Pat. No. 7,308,740.

BACKGROUND OF THE INVENTION

1. Field of Invention

The present invention is related generally to the field of receptacles and more particularly to a container for use with the scattering of cremains and an urn which is adapted to contain such a container.

2. Description of Related Art

The cremation of the mortal remains of living creatures, such as pets, has become increasingly popular. This increasing popularity results in part from a change in demographics, and because it is less expensive than in ground burials. The result of the cremation process is a volume of bone fragments which are normally reduced to a fine ash by grinding, resulting in about one cubic inch of cremated remains per pound of live body weight.

Some pet owners, or family or friends, choose to retain the cremated remains as a physical memorial of the departed loved one. Some cremation urns take the form of a vase. However, there are many styles where the cremains of the lost loved are to placed. Some pet owners choose to scatter the cremains, but may do so at a later date, and in a different location, such as a summer home, a cabin, over water, etc.

In some cases, the user may initially retain the cremains in a cremation urn constructed of permanent or semi-permanent materials, allowing for the attachment of a plaque, or to otherwise engrave the identification of the pet and an epitaph. For many, the dispersal of the cremains is too difficult emotionally, and for this or many other reasons the cremains are retained. After a period of recovery, the user may then be ready to scatter the cremains in a closure ceremony. Thus, a device which facilitates this process is of great use.

There is an accelerating trend in the afterlife industry towards personalizing funeral products purchased for the deceased. Rather than providing basic plastic or tin box urns, for example, such personalizing may include an image remembrance, or an engraved image, and in some cases this image is customized to be or contain a photograph of the deceased, or, for animals, an image that includes a breed depiction of the pet in a choice of settings, for example, a farm, country, beach, or mountain setting.

What is called for is a scatter urn that is adapted to contain cremains that can safely hold and contain the cremains. What is also called for is a scatter urn that can be used easily to scatter the cremains should the user choose to do so. What is also called for is a scatter urn that may reside within a permanent or semi-permanent cremation or memorial urn to allow for the proper scattering of the deceased's cremains at a time of the user's choosing, and which can be removed from the memorial urn for that purpose. In such a circumstance, the cremation urn first functions as a cremation urn with the scatter urn within it, and after removal of the scatter urn and the scattering of the cremains, the outer urn becomes in essence a memorial. Some choose to retain a portion of the cremains and scatter the remainder. Some choose to divide the cremains between owners who are no longer together such as in divorce or separation.

What is also called for is an urn that can be custom engraved, and easily re-engraved in case of error without scrapping an entire urn. What is also called for is an urn which allows for a reduced inventory yet allows for prompt delivery to grieving loved ones. What is also called for is such an urn that is adapted to contain a scatter box, or scatter urn, within it.

BRIEF SUMMARY OF THE INVENTION

A scatter urn adapted for the dispersal of cremains. A cremation urn with a scatter urn within it that can be easily removed. A cremation urn with a removable and replaceable panel(s) which allows for placement of an image, such as by laser engraving, on a removable panel, with a scatter urn within it. A cremation urn with a memorial photograph with a scatter urn within it.

DETAILED DESCRIPTION

Figure 1A:
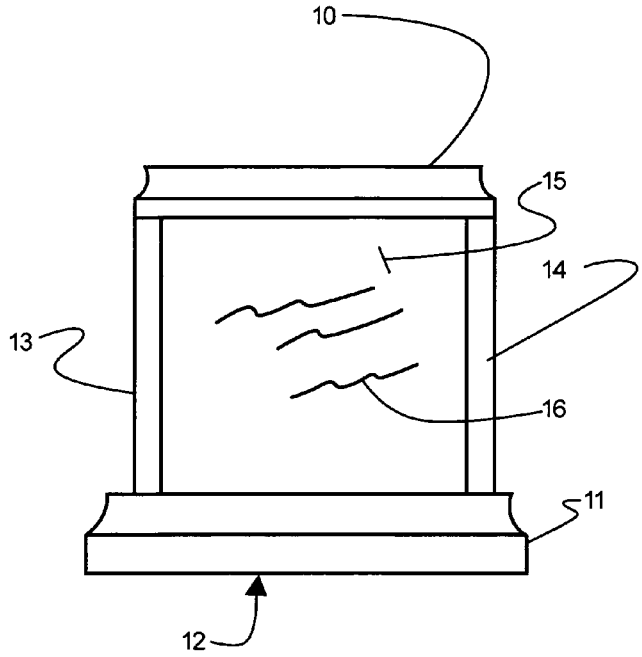
FIGS. 1A-B are front and a cross-sectional view of an urn with a scatter urn according to some embodiments of the present invention.
Figure 1B:
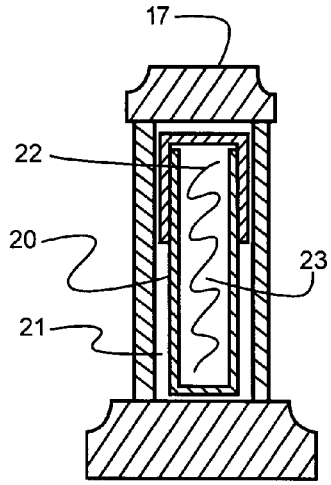
Figure 2:
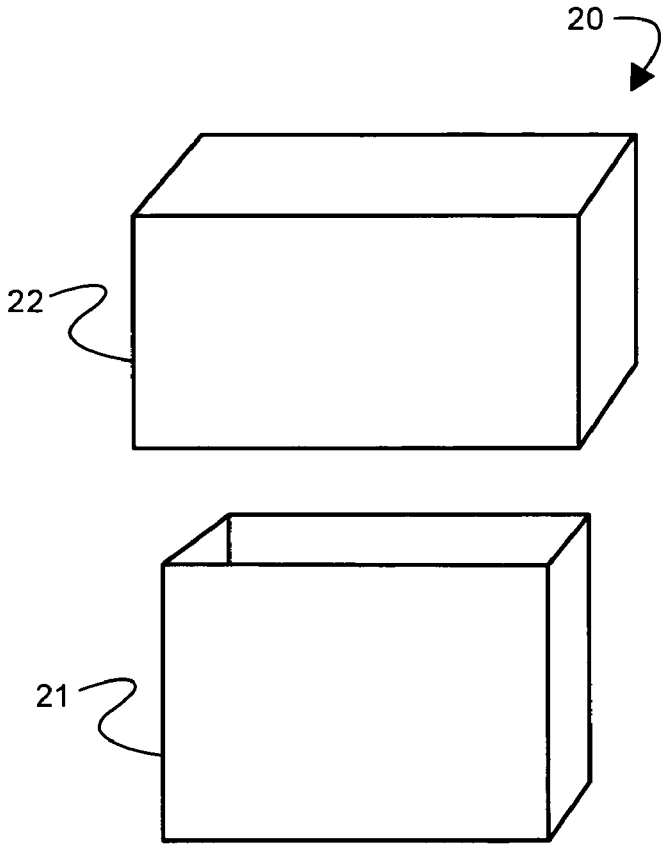
FIG. 2 is a view of a scatter urn according to some embodiments of the present invention.
Figure 3:
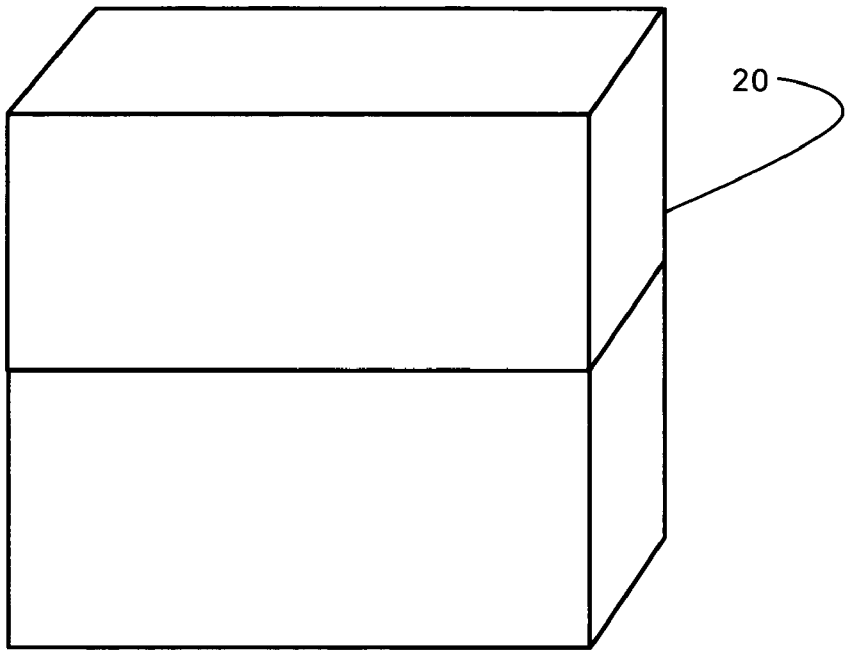
FIG. 3 is a view of a scatter urn according to some embodiments of the present invention.

FIGS. 1A and 1B illustrate a front view and a cross-sectional side view, respectively, of a cremation urn 10 including an enclosed scatter urn 20 residing therein according to some embodiments of the present invention. The bottom surface 12 of the urn base 11 is adapted to rest upon on a flat surface. The side panels 13, 14 are in substantial contact with the base along their bottom edges. In some embodiments, the side panels 13, 14 are wood and are substantially rectangular in shape. In some embodiments, the side panels 13, 14 are substantially parallel to each other. The urn front panel 15 resides between the side panels 13, 14 as viewed from the front. An image 16 is seen on the front panel 105 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the pet or person whose remains reside within. The top portion 17 covers over the top of the box created by the front, side, and rear panels, and in conjunction with the base define and enclosed space within the urn. The cremation urn may have other geometries is other embodiments.

As seen in FIG. 1B, the enclosed space within the cremation urn contains a scatter urn 20 adapted to fit within the enclosed space. The scatter urn 20 may have a top portion 22 and a bottom portion 21 in some embodiments. A volume of cremains 23 are seen within the scatter urn 20.

Although the specific cremation urn 10 of FIGS. 1A and 1B is illustrated, the cremation urn may be of other shapes or geometries. The cremation urn should be able to be opened to retrieve the scatter box. In some embodiments, the cremation urn may be opened by the removal of its base, which may be attached with threaded fasteners. In other embodiments, the urn may have a slide out panel, a removable rear panel, a removable top, or other means with which to access the enclosed space therein.

FIGS. 2-5 illustrate a scatter urn 20 according to some embodiments of the present invention. The scatter urn 20 may have a top portion 22 and a bottom portion 21. An adhesive strip 27 may be attached to the bottom portion 21 of the scatter urn 20 and be adapted to enhance the fastening of the top portion 22 to the bottom portion 21. The adhesive strip 27 may be of a light adhesive such that the two portions of the scatter urn can be readily disassembled when necessary for dispersal of the cremains. In some embodiments, the fit of the top portion 22 to the bottom portion 22 is sufficiently tight such that when the top portion 22 is slid over the bottom portion the overlap prevents leakage of material from within the box.

Although the top portion is illustrated as sliding down approximately half way down the outside of the bottom portion of the scatter urn, other relative sizes may be used. For example, the top portion 22 may extend all the way to the bottom of the bottom portion 21 when slid down all the way onto the bottom portion 21. In other cases, the top portion may be a fraction of the height of the bottom portion.

In some embodiments, the scatter urn may be made of a somewhat rigid material such as cardboard. In some embodiments, the scatter urn may be made of plastic or other suitable materials. Typically, in current practice, and especially in the case of pet animals, the cremains are typically contained within a sealed plastic bag. These plastic "baggies" may be vulnerable to ripping, and may even rip once a small nick has been made in the plastic bag. In contrast, a scatter urn of a more durable and rigid material is far more protective. A clear bag may also create an emotionally difficult situation for the user who sees the cremains. A closed box does not create this emotionally difficult situation.

In addition, the somewhat rigid material of the scatter urn 20 makes the process of scattering cremains easier. With a plastic bag, which has no shape of its own, one may begin pouring cremains in the scattering process and all of a sudden all of the cremains come pouring out, leaving a lump. With the scatter urn, the cremains may be gently dispersed in a controlled fashion. This greatly enhances the ease and the results of the scattering process. In some governmental jurisdictions, it is unlawful to scatter cremains in a manner that results in a lump of cremains. The enhanced evenness of scattering that the scatter box affords addresses that concern, precluding the emotionally difficult, as well as dirty, task of having to further deal with the cremains on the ground or floating in a lump on water.

Figure 5:
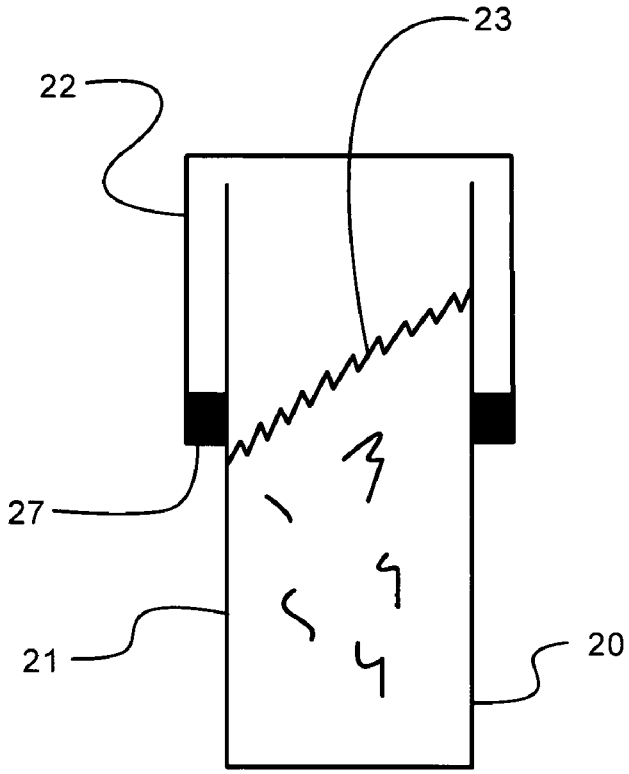
FIG. 5 is a cross-sectional view of a scatter urn according to some embodiments of the present invention.

FIG. 5 illustrates a typical cross sectional side view of a scatter urn 20. Cremains 23 are seen within the confines of the scatter urn 20. In some embodiments, the cremains will be added into the bottom portion 21 of the scatter box 20, and the top portion 22 will then be placed over the bottom portion 21 of the scatter box 20. The scatter urn 20 may depend on the relatively tight fit of the top to the bottom for a seal. In some cases, the user may choose to later scatter the cremains in remembrance of the deceased. In some embodiments, this scattering may be done by sliding the top portion 22 off of the bottom portion 21 of the scatter urn 20 and pouring out the cremains.

Figure 4:
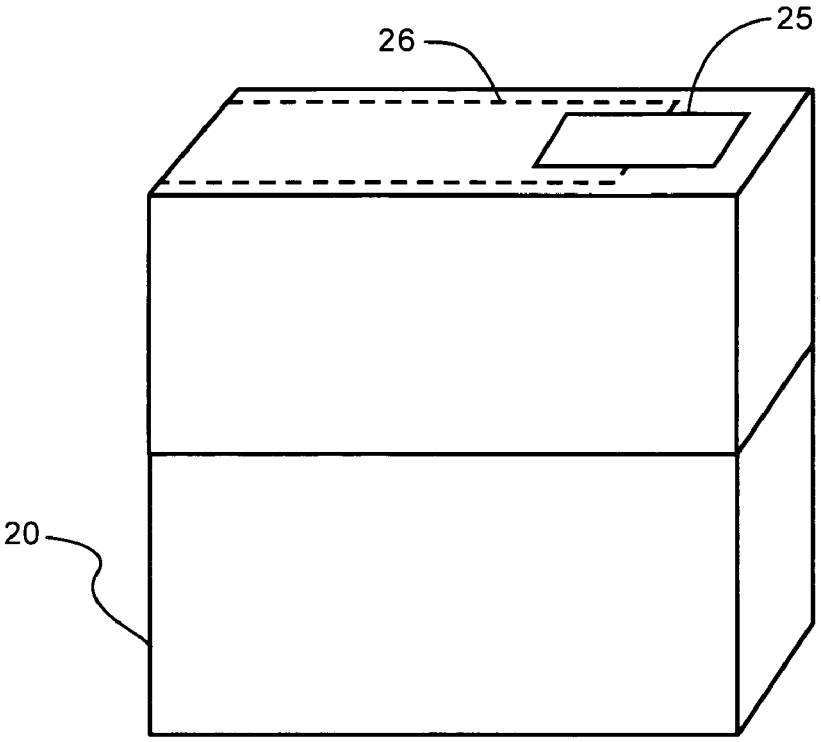
FIG. 4 is a view of a scatter urn according to some embodiments of the present invention.

FIG. 4 illustrates another embodiment of the scatter urn according to some embodiments of the present invention. A tear strip 25 is attached to a tear portion 26 of the scatter urn 20. The tear portion 26 may be a portion of the box that is outlined with serrations in the box material. The scatter urn 20 may be of cardboard or other fibrous materials in some embodiments. The tear strip 25 may be affixed to the tear portion such that when the tear strip is pulled, the serrated edges of the tear portion 26 yield, thus opening a strip in the top of the scatter urn. The user may then disperse the cremains through this opening in the top of the box. In some embodiments, the tear portion may be used in conjunction with a scatter urn whose top and bottom portions have been joined together.

With the use of the scatter urn without the tear strip, the scattering process may be as follows. The scatter urn is removed from the cremation urn if it had been previously contained within the cremation urn. The top portion of the scatter urn is removed from the bottom portion of the scatter urn, with the cremains then in the bottom portion of the scatter urn. Due to the relatively rigidity of the bottom portion of the scatter urn, the bottom portion can be easily handled to allow for the controlled dispersal of the cremains.

Figure 6:
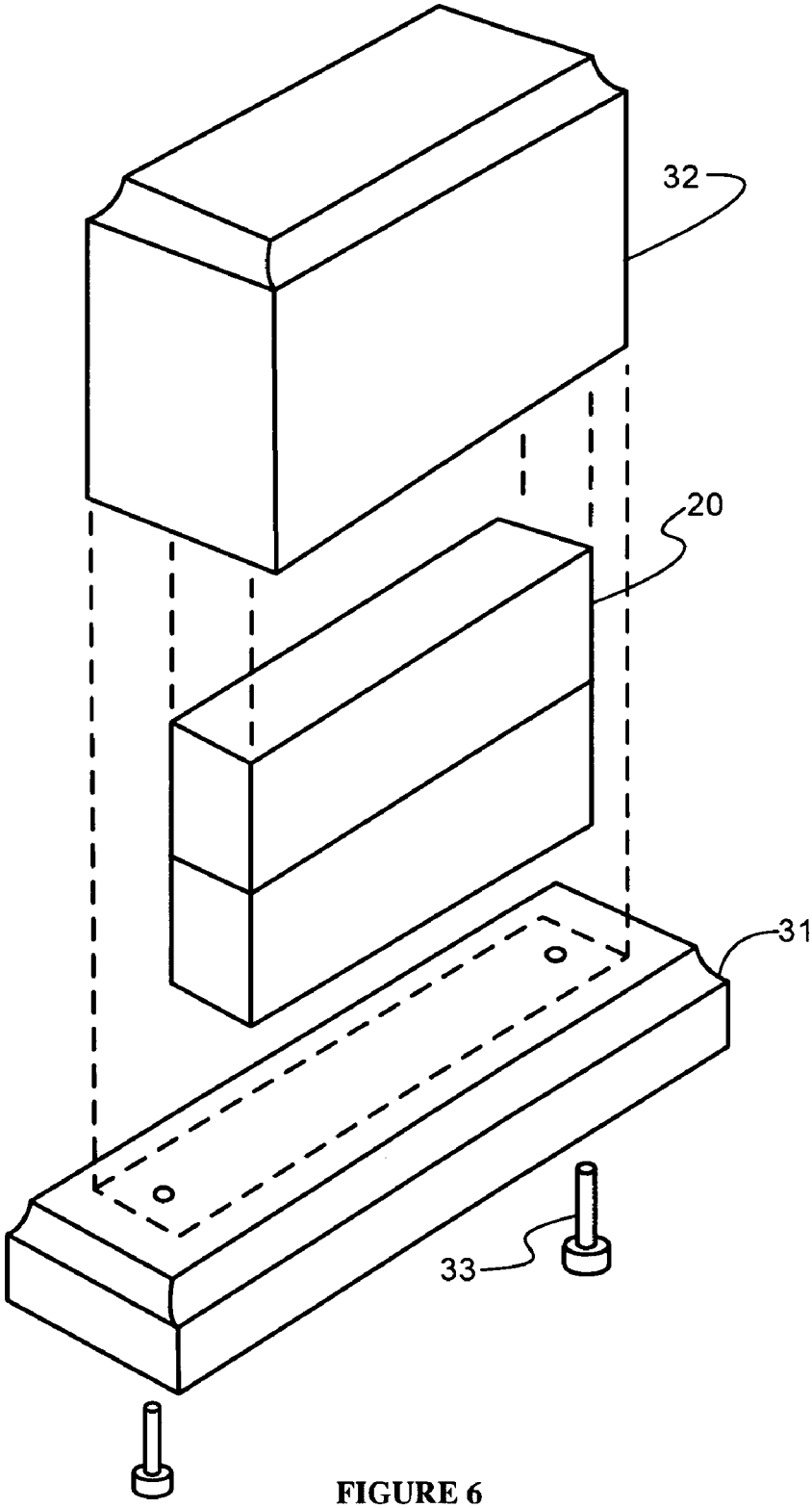
FIG. 6 is an exploded view of a cremation urn with a scatter urn therein.

FIG. 6 is an exploded view of a cremation urn containing a scatter urn according to some embodiments of the present invention. The urn body 32 may have an easily removeable base 31, which may be attached with fasteners 33. The urn body may define an enclosure therein adapted to receive a scatter urn 20. Whereas in other embodiments the cremains may be inserted into the urn in a tight, sealed package, by using instead the scatter urn the cremains may be later removed from the urn and scattered. The user may retain the urn as a memorial urn as a further remembrance after the scatter urn has been removed.

Figure 7:
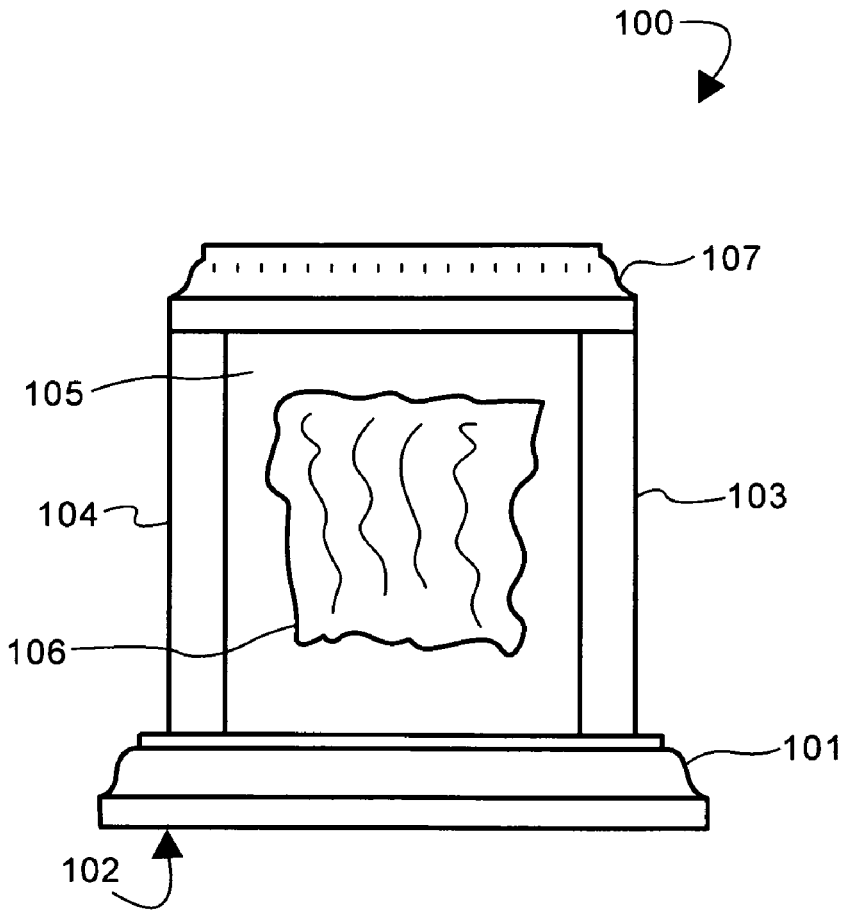
FIG. 7 is a front view of an urn according to some embodiments of the present invention.

FIG. 7 illustrates an urn 100 according to some embodiments of the present invention. The bottom surface 102 of the urn base 101 is adapted to rest upon on a flat surface. The side panels 103, 104 are in substantial contact with the base 101 along their bottom edges. In some embodiments, the side panels 103, 104 are wood and are substantially rectangular in shape. In some embodiments, the side panels 103, 104 are substantially parallel to each other. The urn front panel 105 resides between the side panels 103, 104 as viewed from the front. An image 106 is seen on the front panel 105 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the pet or person whose cremains reside within. The top portion 107 covers over the top of the box created by the front, side, and rear panels.

Figure 8:
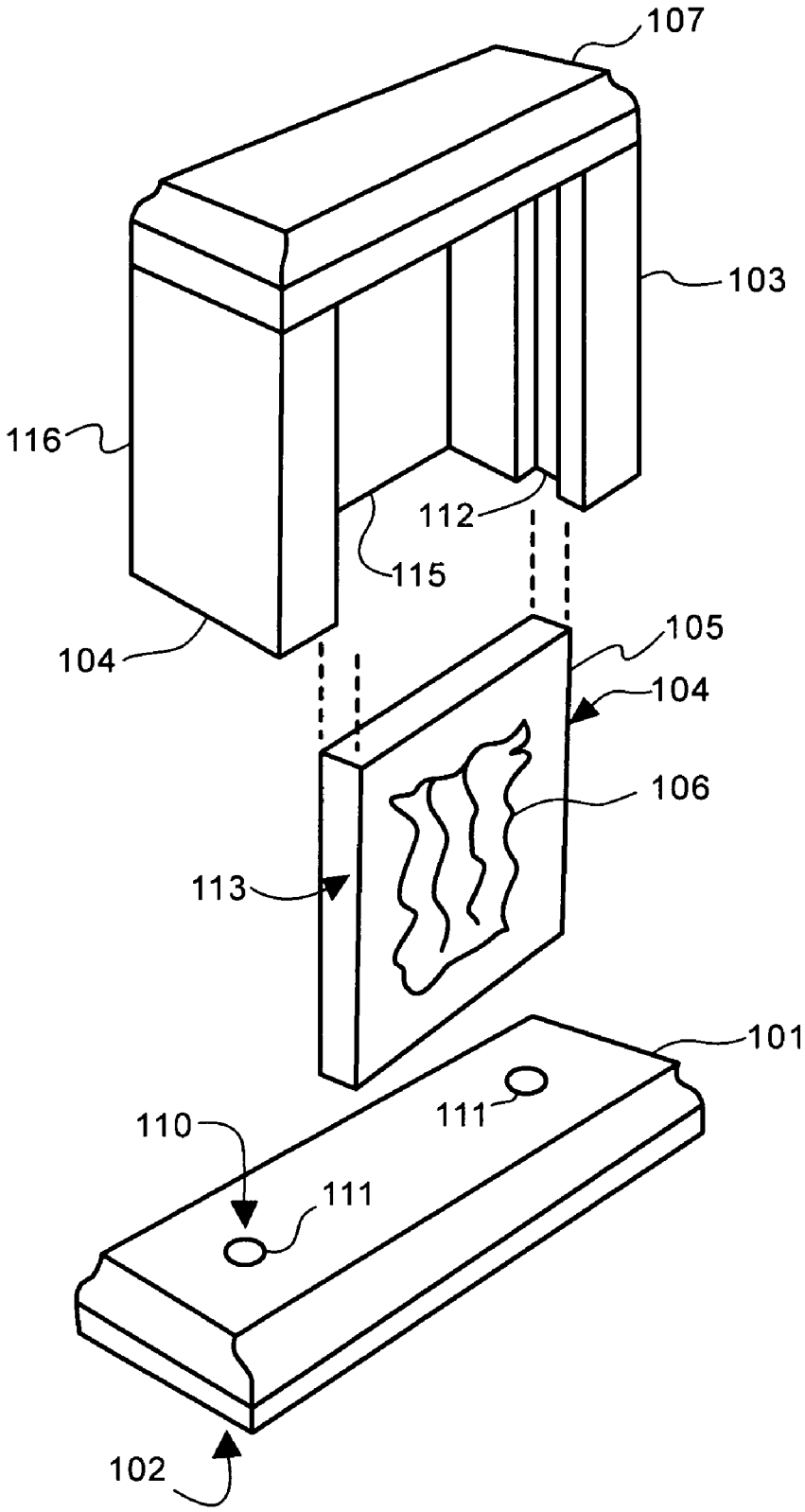
FIG. 8 is an exploded perspective view of an urn according to some embodiments of the present invention.
Figure 10:
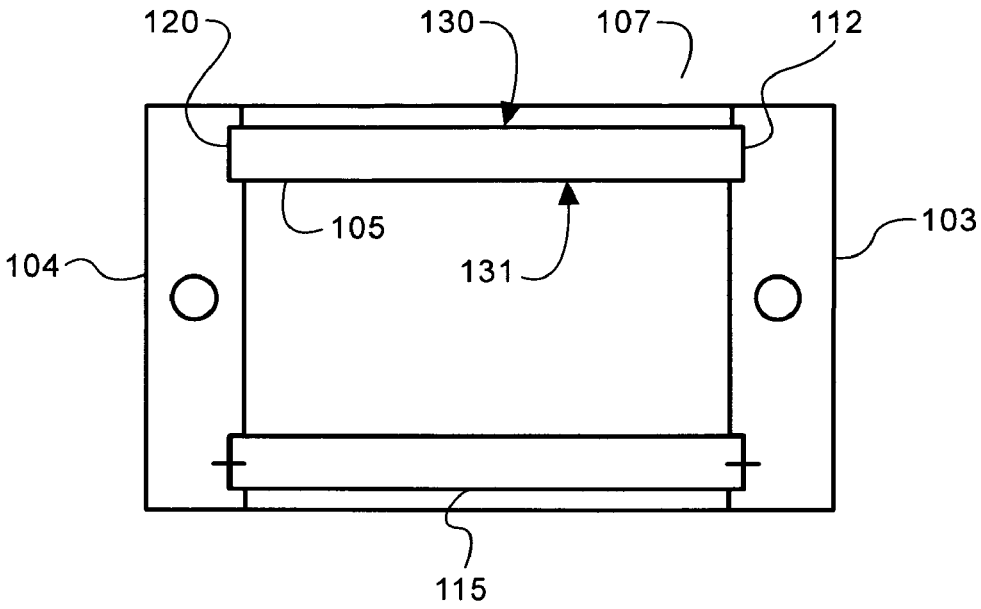
FIG. 10 is a bottom view of an urn body including a removable panel according to some embodiments of the present invention.

FIG. 8 illustrates an exploded view of an urn according to some embodiments of the present invention. The bottom surface 102 of the base 101 is adapted to lay on a flat surface in some embodiments. Holes 111 in the base 101 are used for attaching the base 101 to the urn body 116. Screws are used to attach the base 101 to the side panels 103, 104. The screws may come up through the base 101 and thread into threaded inserts in the side panels, or they can be threaded directly into the side panels. The top portion 107, the side panels 103, 104, and the back portion 115 may be pre-assembled into the urn body 116. The front panel's sides 113, 114 may be inserted into slots 112, 120 in the side panels. In some embodiments, the front panel 105 slides into the urn body from the bottom. In some embodiments, the front panel 105 fits snugly into the slots 112, 120, and is sized so that it just fits vertically within the space between the top portion 107 and the base 101. In some embodiments, the front panel has slots in it which fit into guides on the side panels. The front panel 105 is easily removable and replaceable. The top surface 110 of the base 101 then captures and retains the front panel 105 when the base 101 is attached to the urn body 116. In some embodiments, the top surface 110 of the base 101 is substantially flat. In some embodiments, the top surface 110 of the base 101 may be recessed for the urn body and front panel. With the front panel in place and the base attached, the urn becomes a closed receptacle which can be used for the cremains of a cremated pet or person in some embodiments. Typically, the cremains will be in a separately sealed bag. As seen in FIG. 10, the remains (cremains) 148, typically in a sealed bag, reside within the urn. The front panel 105 is adapted to be easily removed from the urn body 116 when the base 101 is removed.

In some embodiments, the front panel will have an image 106. In some embodiments, the image 106 will be an engraved image. In some embodiments, the image 106 will be engraved by a laser. In some embodiments, the image may be engraved using other methods, or may be marked using another method. The image on the front panel may be customized to suit the desires of a purchaser. Because of the multitude of possible images, the front panel may be engraved as one of the last steps in the assembly process. For example, distributors may have an inventory of urns without front panels permanently attached. When an urn is desired with a particular image, a front panel may be engraved separately and inserted after engraving. The engraving of the front panel separately from the rest of the urn has many advantages. If the image is not engraved properly, the image may be re-engraved on the other side of the front panel, so that the front panel does not need to be scrapped. The image may also be re-engraved on another replacement front panel. In this case, the entire urn does not have to be discarded. In either case, the easily removable and replaceable front panel allows for economy of inventory, and allows for a manufacturing error in engraving to be absorbed without wasting a potentially expensive urn. In addition, the engraving of only the substantially flat and rectangular front panel, as opposed to an engraving process where the entire and bulky urn is placed in the engraver if the engraving is done on a panel already assembled into an urn, may allow for a much easier, accurate, and controllable engraving process. Utilizing such a system, an afterlife service and product provider may be able to keep a reduced inventory of plain (unengraved) urns. When an order for a custom engraving is received, the front panel may be manufactured and then easily mailed to the provider, where the cremains are added and it is then assembled into a completed unit. The expedited delivery of only the decorative panel allows for the use of inexpensive overnight or priority delivery in a small padded envelope, for example, as opposed to a much longer delivery time for a parcel with an entire urn.

Figure 15:
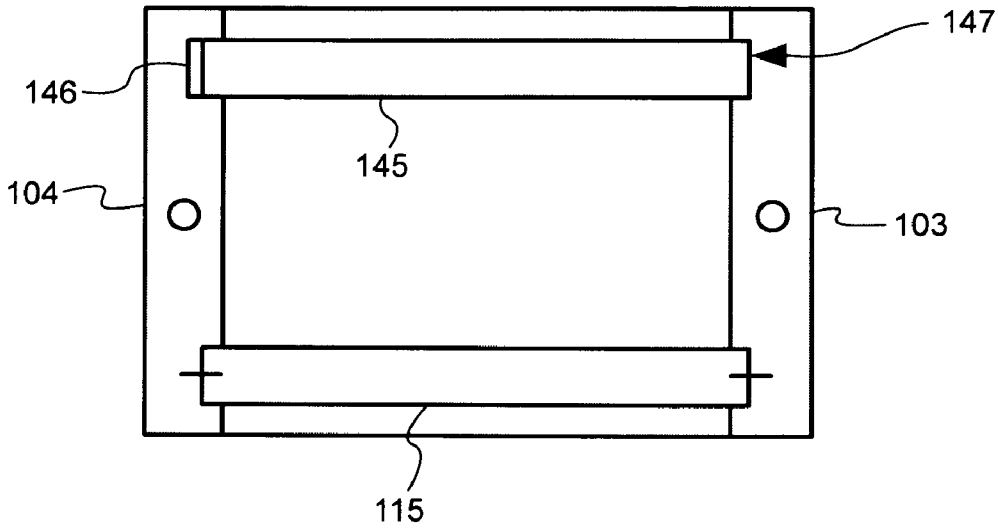
FIG. 15 is a bottom view of an urn body including a four-sided box with a removable additional panel and a shim according to some embodiments of the present invention.
Figure 16:
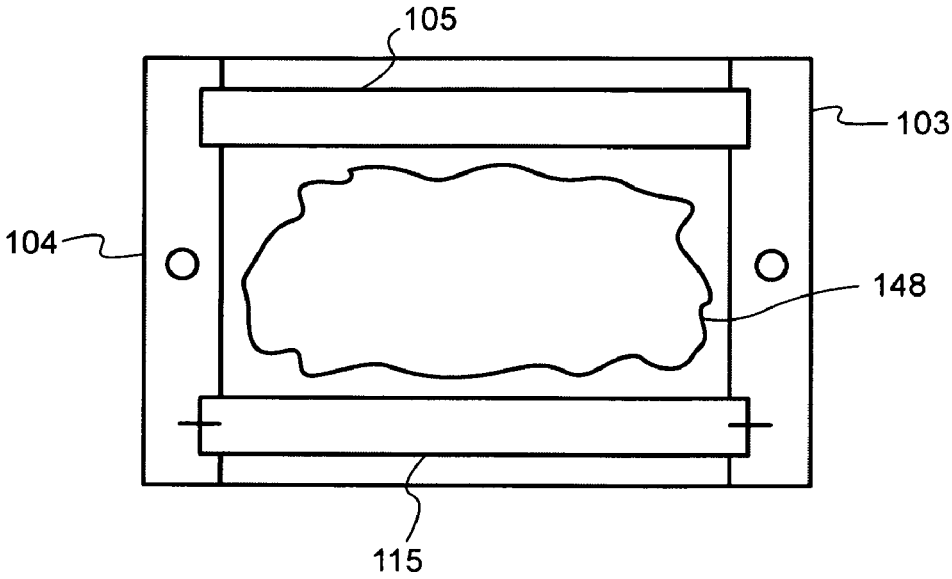
FIG. 16 is a bottom view of an urn body including a four-sided box with a removable additional panel and cremains according to some embodiments of the present invention.

In some embodiments, the image on the front panel of the urn may be of acceptable image quality such that it is not rejected on that basis, but may be off-center horizontally. In such a case, as seen in FIG. 15, the edge 147 of the panel 145 may be removed by planing or other methods. A shim 146 of appropriate thickness may be inserted into the slot where the other side of the panel resides in order to maintain the snug fit of the now centered panel.

Figure 9:
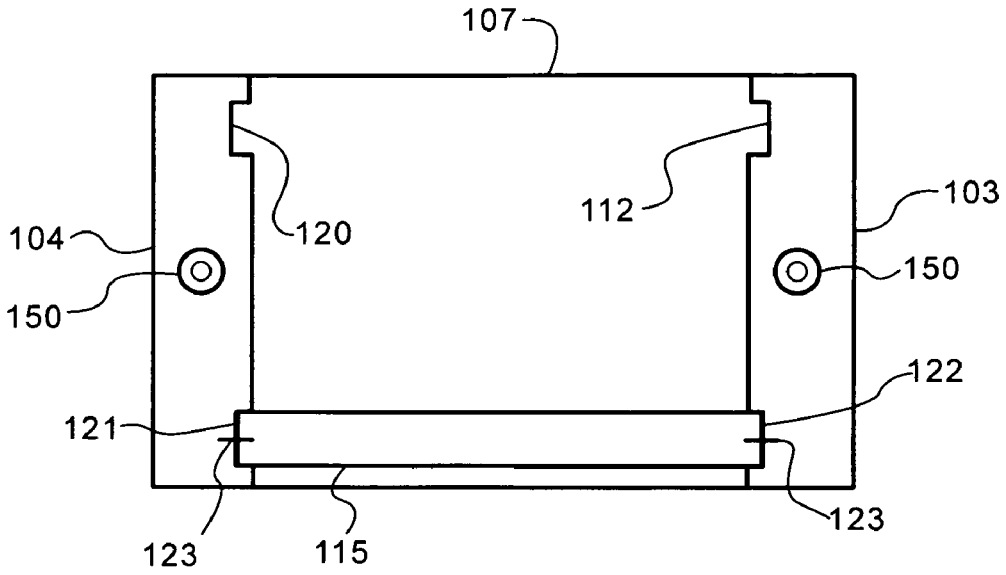
FIG. 9 is a bottom view of an urn body according to some embodiments of the present invention.

In some embodiments, as seen in bottom view in FIG. 9, an urn body has a two side panels 103, 104. The side panels 103, 104 have slots 112, 120 for the later insertion of a front panel. The rear portion 115 has been more permanently affixed into slots 121, 122 in the rear portion of the side panels 103, 104. Slats 123 may be used to fasten the rear portion 115 in some embodiments. In some embodiments, the rear portion 115 is a single panel. In some embodiments, the rear portion is an assembly of pieces. The top portion 107 is affixed to the tops of the rear portion 115 and the side panels 103, 104. In some embodiments, the top portion is affixed using adhesives. In some embodiments, the rear portion is affixed to the side panels with adhesives, or staples or screws. In some embodiments, the base is attached to the urn body with threaded fasteners. The fasteners may come up through the bottom of the base and into threaded keepers 150 in the side panels 103, 104, or directly into the urn.

FIG. 10 is a bottom view of an urn body with a front panel 105 inserted. A first side 130 and a second side 131 of the front panel 105 may be used for the engraving of an image. In some embodiments, the front panel 105 is made of wood or other material, such as a composite material. In some embodiments, the image is engraved on the front panel 105 with a laser or other engraving device. An image may be engraved on the first side 130 of the front panel 105 prior to the insertion of the front panel 105 into the urn body. If, upon inspection, the image on the front panel does not meet standards when the urn is assembled, the urn may be disassembled and the front panel may be re-used on the second side 131. The urn may then be re-assembled with the second side 131 facing outwards. In some cases, the front panel may be manufactured with a different view on each side, allowing the customer to select which image is preferred upon review. For example, a dog breed may have either uncropped ears or cropped ears, or either an uncropped tail or a cropped tail. An image of each may be engraved, one on each side of the panel. The correct depiction may be displayed when the urn is fully assembled, without delaying the assembly process and the delivery of the urn.

Figure 11:
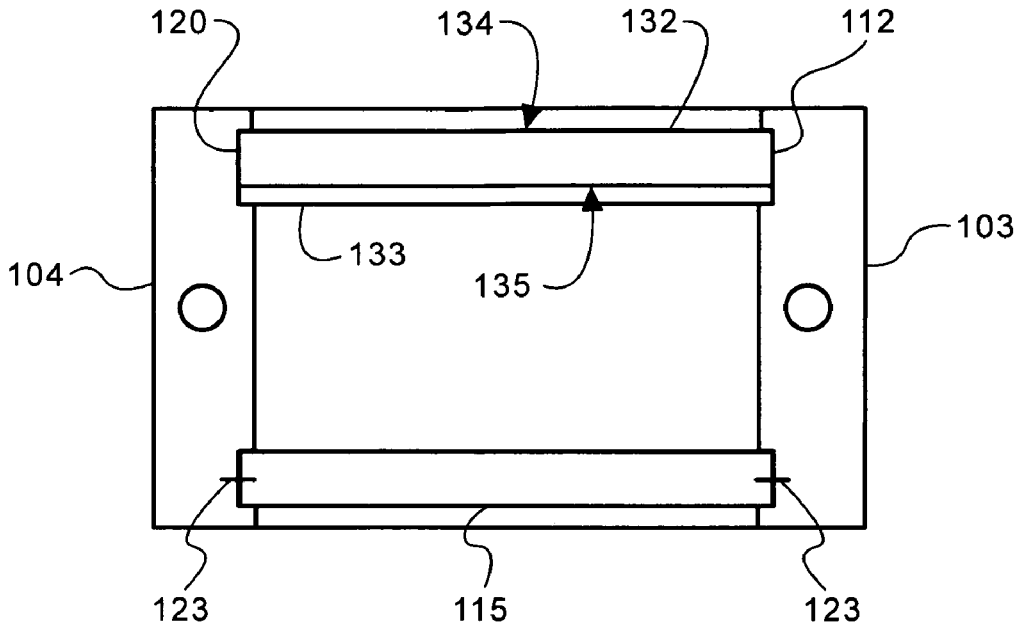
FIG. 11 is a bottom view of an urn body including a removable panel/clear pane combination according to some embodiments of the present invention.
Figure 12:
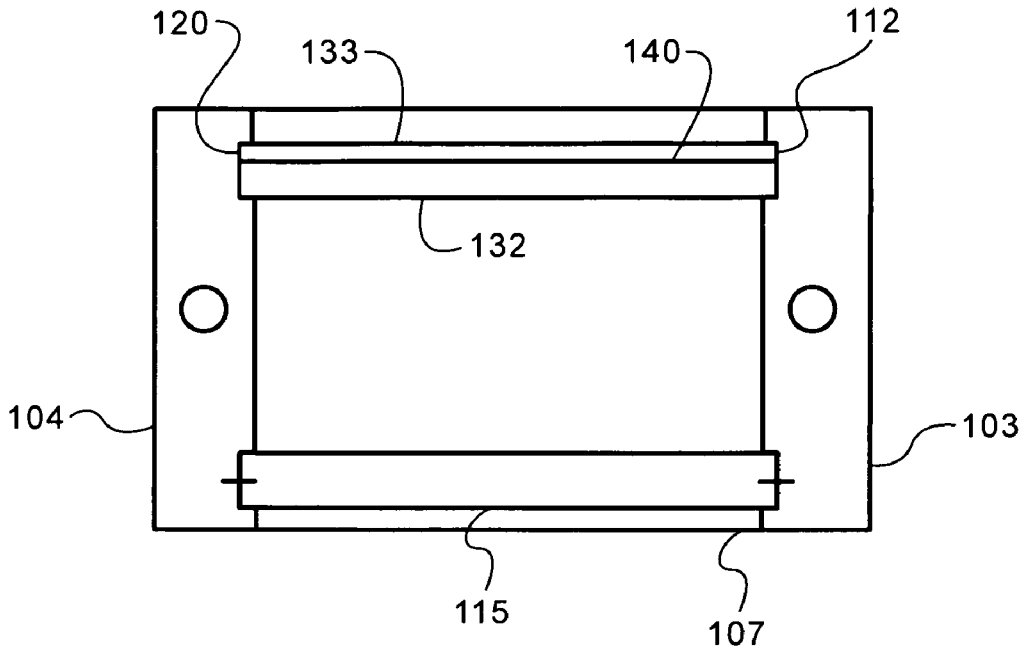
FIG. 12 is a bottom view of an urn body including a removable panel/clear pane combination according to some embodiments of the present invention.

In some embodiments, as seen in bottom view in FIGS. 11 and 12, the slots 112, 120 in the side panels 103, 104 may be adapted to seat a first partial panel 132 and a second partial panel 133. In some embodiments, the first partial panel 132 is made of wood, and the second partial panel 133 is a pane made of a clear material, such as acrylic. In some embodiments, the two partial panels 132, 133 are sized such that there combined thicknesses allow for a snug fit into the slots 112, 120 in the side panels, while still allowing for easy removal and replacement. The two partial panels allow for the same combination of parts to be used while offering a variety of advantages. The first partial panel 132 may be engraved on one of its surfaces 134, 135 such that an image is displayed outwardly. As in other embodiments, the first partial panel 132 may be engraved separately from the urn. Also, the first partial panel 132 may be engraved on the second surface if there is a manufacturing or other problem with the engraving on the first surface. The second partial panel 133 may be inserted on the outside of the first partial panel 132 in some embodiments. A photograph or other image 140 may be inserted between the first partial panel 132 and the second partial panel 133 and will be visible to a viewer observing the urn. In some embodiments, a decorative mat may be used between the image and the clear panel.

Figure 13:
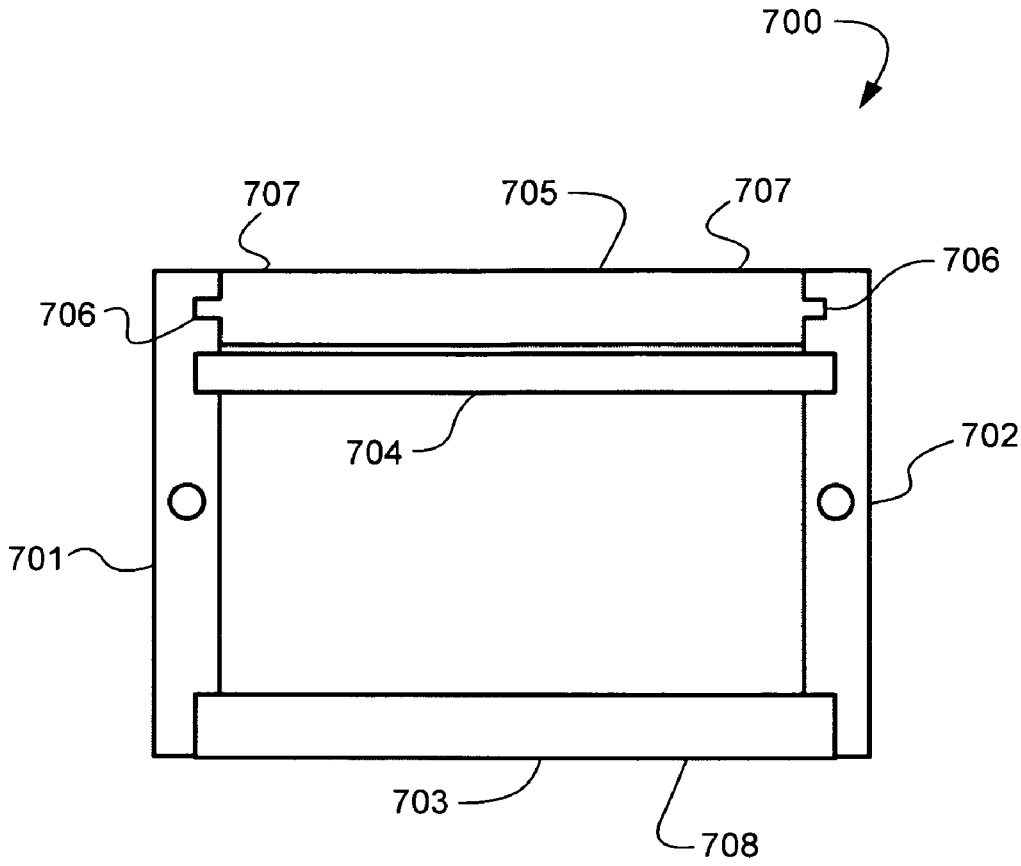
FIG. 13 is a bottom view of an urn body including a four-sided box with a removable additional panel according to some embodiments of the present invention.

In some embodiments of the present invention, as seen in FIG. 13, an urn 700 is shown in bottom view without its base. Two side panels 701, 702 are joined to a back panel 703. In some embodiments, the back panel 703 is made from one or more pieces of wood or other suitable material. A top panel 708 resides on the top of the box assembly.

A front panel 704 is attached to the two side panels 701, 702. The side panels 701, 702 extend past the front panel. A removable panel 705 with guides 707 slides into slots 706 in the side panels 701, 702. In some embodiments, the slots may be in the removable panel. An image may be engraved on either surface of the removable panel 705.

Figure 14:
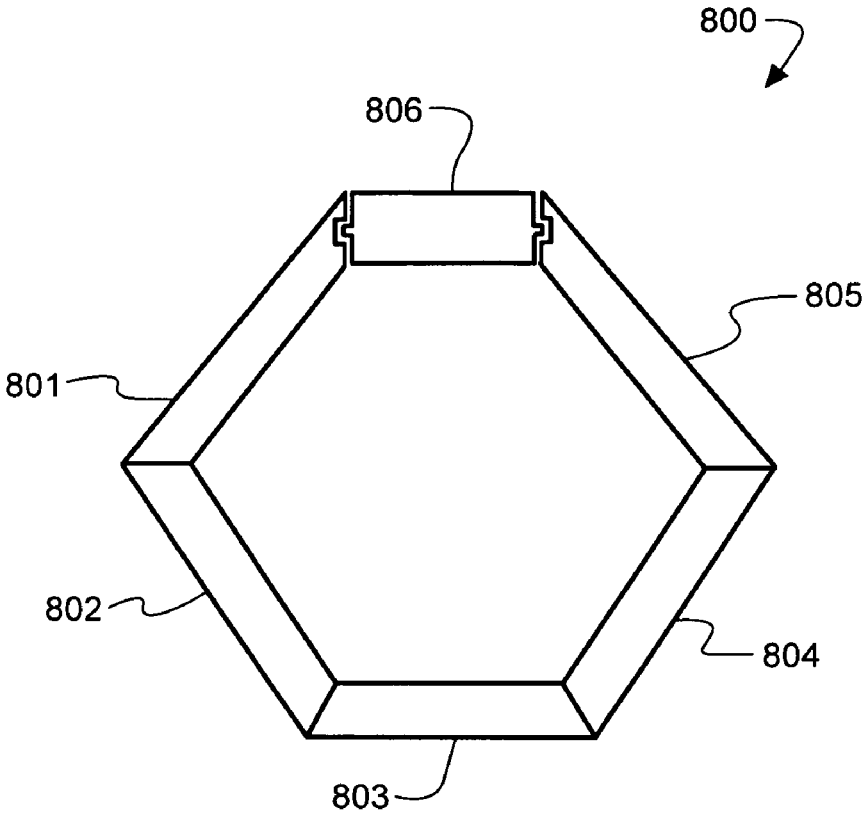
FIG. 14 is a bottom view of a multi-sided urn body with a removable additional panel according to some embodiments of the present invention.

In some embodiments of the present invention, as seen in FIG. 14, the urn body is multi-sided. An urn 800 has a plurality of panels 801-805 joined together to form an urn body. A removable panel 806 is adapted to slide into the urn body. The removable panel is adapted to be captured by the base when the base is attached to the urn body.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. A scatter urn for storing cremains, said scatter urn comprising:

a top portion, said top portion comprising:

a top; and four walls, said four walls and said top forming a bottomless enclosure;

a bottom portion, said bottom portion comprising:

a bottom; and four walls, said four walls and said bottom forming a topless enclosure;

a tear portion, said tear portion adapted to be easily torn from said scatter urn; and a tear strip, said tear strip affixed to said tear portion such that pulling of the tear strip creates an opening in the scatter urn at the tear portion to allow for dispersal of the cremains through the opening wherein said walls of said top portion are sized so they snugly fit over said walls of said bottom portion, thereby forming a secure enclosure for the cremains therein.

2. The scatter urn of claim 1 wherein said top portion and said bottom portion comprise cardboard.

3. A scatter urn for storing cremains, said scatter urn comprising:

a top portion, said top portion comprising:

a top; and four walls, said four walls and said top forming a bottomless enclosure;

a bottom portion, said bottom portion comprising:

a bottom; and four walls, said four walls and said bottom forming a topless enclosure;

a tear portion, said tear portion adapted to be easily torn from said scatter urn;

wherein said walls of said top portion are sized so they snugly fit over said walls of said bottom portion, thereby forming a secure enclosure for the cremains therein, and wherein said tear portion is defined by serrations in said scatter urn.

4. The scatter urn of claim 3 wherein said top portion and said bottom portion comprise cardboard.

5. An urn for storing cremains, said urn comprising:

an urn body, said urn body defining a first cavity therein;

a base, said base adapted to fasten to a bottom of said urn body; and a scatter urn for storing the cremains, said scatter urn residing within said first cavity, wherein said urn body further comprises:

a first side panel, said first side panel having a inside face facing the interior of said urn body;

a second side panel, said second side panel having an inside face facing the interior of said urn body;

a back portion, wherein said back portion is joined to said first side panel and to said second side panel;

a top portion, said top portion joined to a top of said urn body; and a bottom edge at the bottom of said urn body;

a front panel portion, said front panel portion adapted to fit with said urn body to form a fourth side of a box structure, wherein said first side panel, said second panel, and said back portion define a first, second, and third side, respectively, of said box structure;

wherein said first side panel comprises a first slot along its inside face, and wherein said second side panel comprises a second slot along its inside face, and wherein said first slot and said second slot extend to said bottom edge of said urn body, said first slot and said second slot adapted to capture two opposing sides of said front panel portion.

6. The urn of claim 5 wherein the outer periphery of said two opposing sides of said front panel portion are adapted to fit within said first and said second slots.

7. The urn of claim 6 wherein said front panel portion is easily removable and replaceable.

8. The urn of claim 7 wherein said scatter urn comprises:

a top portion, said top portion comprising:

a top; and four walls, said four walls and said top forming a bottomless enclosure; and a bottom portion, said bottom portion comprising:

a bottom; and four walls, said four walls and said bottom forming a topless enclosure.

9. The urn of claim 8 wherein said walls of said top portion are sized to snugly fit over said walls of said bottom portion, thereby forming an enclosure for the cremains therein.

* * * * *